United States Patent [19]

Moked et al.

[11] 4,128,343

[45] Dec. 5, 1978

[54] APPARATUS FOR BLENDING GRANULAR MATERIALS

[75] Inventors: Isaac Moked, New Brunswick; Kenneth C. Yi, Belle Mead; John O. McDonald, Englishtown; Jannan G. Lee, Piscataway, all of N.J.

[73] Assignee: Union Carbide Corporation, New York, N.Y.

[21] Appl. No.: 857,815

[22] Filed: Dec. 5, 1977

Related U.S. Application Data

[63] Continuation-in-part of Ser. No. 645,361, Dec. 30, 1975, abandoned.

[51] Int. Cl.[2] ..... B01F 13/02

[52] U.S. Cl. ..... 366/101; 366/107

[58] Field of Search ..... 366/101, 107, 106, 9, 366/341

[56] References Cited

U.S. PATENT DOCUMENTS

| | | | |
|---|---|---|---|
| 2,723,838 | 11/1955 | Peters | 366/107 |
| 3,198,492 | 8/1965 | Schneider | 366/107 |
| 3,258,252 | 6/1966 | Lanier | 366/107 |
| 3,371,912 | 3/1968 | Samler | 366/132 |
| 3,490,655 | 1/1970 | Ledgett | 366/107 |

*Primary Examiner*—Robert W. Jenkins

*Attorney, Agent, or Firm*—Gerald R. O'Brien, Jr.

[57] ABSTRACT

Apparatus is disclosed for blending free-flowing granular materials comprising: an outer chamber having walls which converge toward and terminate in outlet means at the base thereof; substantially vertically-positioned fenestrated blending tube means spaced above said outlet means having a plurality of entrance means therein; solid, conveying tube means extending substantially vertically through and coaxial within said blending tube means and defining an annular space therebetween; an entrainment zone positioned between said base of said conveying tube means and the base portion of said chamber; and gas inlet means positioned in said chamber to discharge gas upwardly into and through said entrainment zone toward the base inlet of said conveying tube means; the distance of the point of gas inlet discharge into said entrainment zone from said base of said chamber is defined by the equation:

$$X \leqq L - r \operatorname{Tan} \alpha$$

wherein X is the distance between the base of said chamber and said point of discharge, L is the overall distance between said base of said chamber and said base of said conveying tube, r is the outer radius of said conveying tube and $\alpha$ is the angle of repose of the granular material being blended.

10 Claims, 8 Drawing Figures

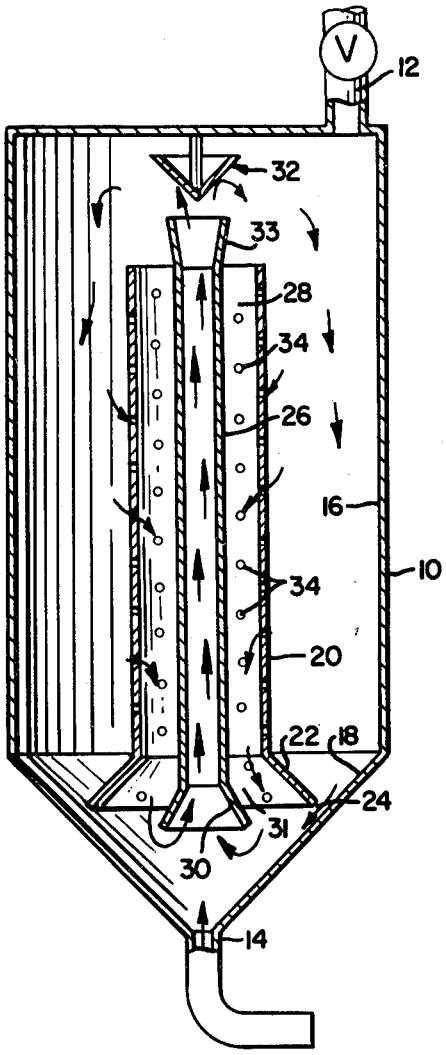
FIG. 1
FIG. 2
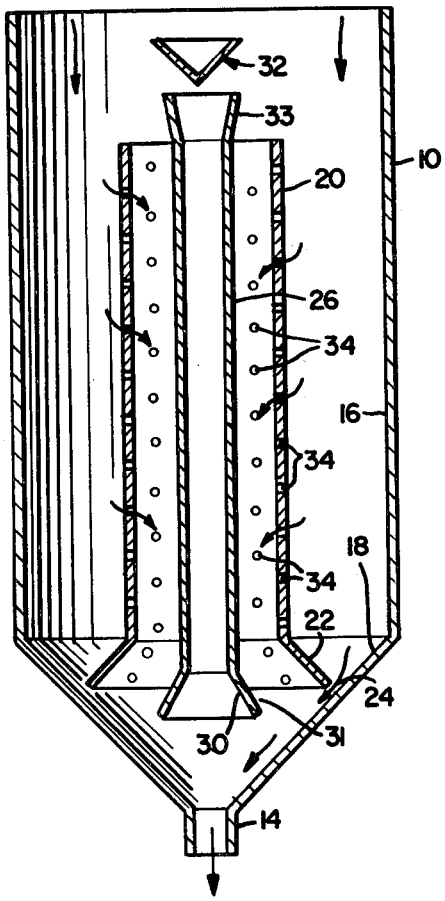
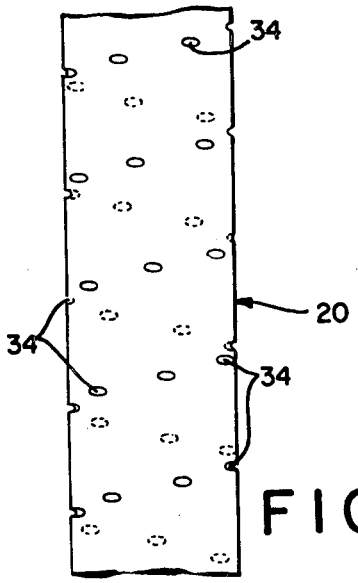
FIG. 1A

APPARATUS FOR BLENDING GRANULAR MATERIALS

This application is a continuation-in-part of our copending application Ser. No. 645,361 filed Dec. 30, 1975, now abandoned, and entitled "Apparatus for Blending Granular Materials."

The present invention relates to apparatus for blending free-flowing granular materials.

The need for adequate blending of granular materials has long been recognized in the art, particularly for blending granular products such as synthetic resins, plastics and the like, to achieve a uniform blend or mixture. Many of these granular products when produced vary on one side or the other of a set standard and must be intimately blended with other similar components in order to minimize variations and non-uniformity of the final blend.

To produce an acceptable uniform blend in blending bins it is necessary to intimately commingle all the component resins. Suitable equipment must therefore positively intermix all the contents of the bin regardless of their respective proportions within the bin.

Heretofore, one disadvantage of using bins for blending granular materials has been that the materials flowing down the bin tend to flow faster down the center, over the outlet, thus causing slower mixing through non-uniform flow. The preferential flow of resin in the center of the bins creates stagnant pockets of resin against the bin walls. Consequently, it is difficult to achieve the desired degree of homogeneity and uniformity in the final blend.

Another apparatus for blending granular materials has been described in U.S. Pat. No. 3,029,986. The apparatus described therein comprises a centrally-positioned fenestrated tube enclosed in a chamber having substantially circular horizontal cross-section such as a hopper, bin, tank, etc. A divergent conical baffle is attached to the lower section of the fenestrated tube and defines an annular clearance with the chamber walls through which an amount of granular materials can flow unimpeded. The centrally-disposed granular materials flow through the fenestrated tube and are intermixed, proportionately with the peripherally disposed granular materials flowing through said annular clearance. The materials are withdrawn through an outlet disposed at the bottom of the bin and circulated, externally, to the top of the bin to further intermix the granular materials and to achieve the desired degree of homogeneity in the final blend.

The blending apparatus described in the above-mentioned patent produces fines and so-called "streamers", i.e., elongated resin particles. The presence of these in the final blend is, of course, undesirable. Furthermore, the use of external transfer means involves additional expenditure, particularly when large quantities of materials are being handled at relatively high rates as is often the case commercially.

Still another apparatus for blending particulate or granular materials has been described in U.S. Pat. No. 3,258,252. The apparatus described therein comprises a centrally-disposed fenestrated tube enclosed in a chamber having substantially circular horizontal cross-section such as a hopper, bin, tank or the like. A divergent conical baffle is attached to the lower section of the fenestrated tube and defines an annular clearance with the chamber walls through which an amount of granular material can flow unimpeded. An inner aspirated tube is positioned in the fenestrated tube and defines an annular space therebetween. A stream of primary air is injected through the base of the chamber and into the lower end of the aspirated tube through flow-accelerating means there positioned. A stream of secondary air is supplied to the inner base of the chamber. A plurality of entrance means are provided in the fenestrated tube to permit the flow of granular material through the tube to the annular space between the fenestrated tube and the inner aspirated tube. Downwardly-projecting shrouds are provided for each of the entrance means to assist in the easy passage of granular material through the entrance means.

The employment of multiple gas streams, the need for inlet flow accelerating means and the need for shrouds covering each of the entrance means of the fenestrated tube provides costly and complicating limitations associated with the use of this apparatus.

It is, therefore, an object of this invention to provide an apparatus for uniformly blending free-flowing granular materials. It is a further object of this invention to provide a commercially feasible and economical blending apparatus wherein large quantities of free-flowing granular materials can be uniformly blended to produce a homogeneous blend, essentially free from fines and streamers.

The above and other objects of this invention are accomplished by the use of a blending apparatus comprising: an outer chamber having walls which coverge toward and terminate in outlet means at the base thereof; substantially vertically-positioned fenestrated blending tube means having a plurality of entrance means therein; solid conveying tube means extending substantially vertically through and coaxial within said blending tube means and defining an annular space therebetween; an entrainment zone positioned between said base of said conveying tube means and the base portion of said chamber; and gas inlet means positioned in said chamber to discharge gas upwardly into and through said entrainment zone toward the base inlet of said conveying tube means; the distance of the point of gas inlet discharge into said entrainment zone from said base of said chamber is defined by the equation:

$$X \leqq L - r \operatorname{Tan} \alpha$$

wherein X is the distance between the base of said chamber and said point of discharge, L is the overall distance between said base of said chamber and said base of said conveying tube, r is the outer radius of said conveying tube and $\alpha$ is the angle of repose of the granular material being blended.

The invention will be more clearly understood from the attached drawings wherein:

FIG. 1 is a vertical sectional view, partly in elevation, of a preferred embodiment of apparatus of the invention;

FIG. 1A is a partial elevational view of the blending tube of the apparatus of FIG. 1;

FIGS. 2, 3, 4, 5 and 6 are vertical sectional views of other embodiments of apparatus of the invention.

Figure 3:
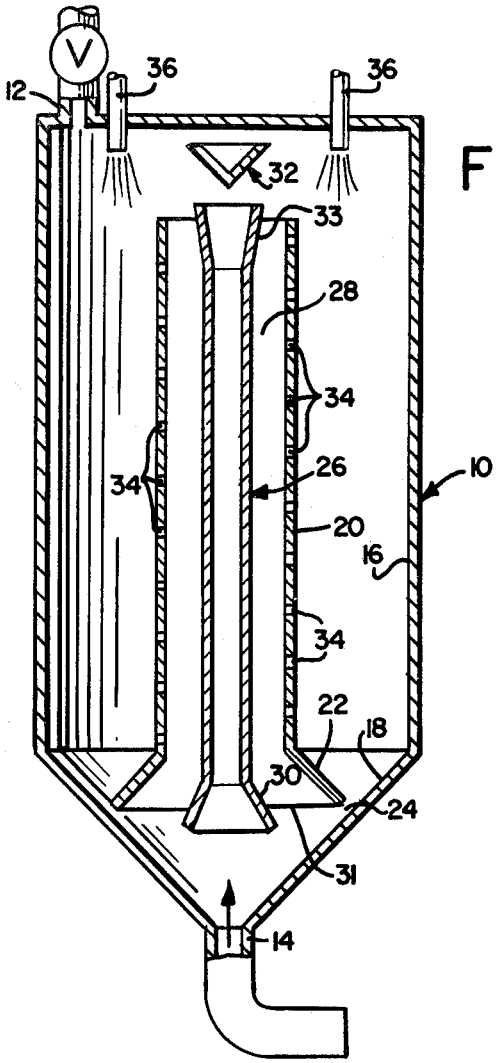

Referring to the drawings, the apparatus in detail comprises chamber 10 preferably of substantially circular horizontal cross-section which is representative of a silo, hopper, bin, tank or like storage structure for free-flowing granular materials. Chamber 10 is provided with an outlet 12 at the top, material outlet 14 at the base and extending therebetween a wall comprising a substantially cylindrical upper wall 16 and a substantially conical lower wall 18.

Mounted in chamber 10 and enclosed by upper wall 16 and lower wall 18 and substantially coaxial therewith is a fenestrated tube 20 spaced above material outlet 14. Positioned around the lower end of the fenestrated tube is a baffle 22 shown as a divergent cone whose peripheral edge cooperates with the lower wall 18 to define an annular space 24 through which an amount of granular material can flow unimpeded. Baffle 22 prevents the preferential flow of the resin near the center of the bin above its outlet.

Enclosed by fenestrated tube 20 and extending coaxially therethrough a solid conveying tube 26 which defines an annular space 28 between the fenestrated tube 20 and conveying tube 26. The tube terminates at its lower end at a point well above the base of chamber 10. Positioned near the lower end of conveying tube 26 is an annular skirt 30 which cooperates with the inner walls of fenestrated blending tube 20 to form an annular space 31. The skirt directs the granular material passing down the annular space between the inner conveying tube and the outer blending tube away from the inlet means for the incoming gas stream.

The conveying tube-fenestrated tube assembly may be securely positioned substantially centrally in chamber 10 by well-known means.

The upper portion of central conveying tube 26 contains outwardly-flaring conical diffuser section 33.

Positioned above the upper end of conveying tube 26 is a deflector 32. The deflector serves to deflect the free-flowing granular materials, air, and fine particles into the large volume at the top of the bin. The decreased velocities in this large volume permits the large granular particles to fall downward while the air, carrying the fine particles, passes upward and out of the chamber by way of outlet vent 12.

Fenestrated tube 20 is an elongated member provided with a plurality of holes or entrance means 34 sized to permit easy ingress of free-flowing granular materials disposed thereabout without edging. The size of the entrance means is determined by the particular granular material sought to be blended and should, of course, be sufficiently large so that the granular materials can flow therethrough without plugging. The shape of the entrance means is not critical provided that the free flow of the granular materials is not impeded. Ease of fabrication will obviously make certain geometrical shapes, e.g., circular or oval, more preferable than others. Similarly, the number of entrance means is not narrowly critical. The fenestrated tube should, however, contain sufficient number of entrance means in order to permit the flow of a predetermined quantity of free-flowing granular materials therethrough. These entrance means should preferably be spaced along substantially the entire length of fenestrated tube 20 including baffle 22 to insure sampling of all layers or portions of the material in chamber 10. Similarly, to insure adequate and representative sampling, the entrance means should also be regularly laterally spaced.

While the exact number and shape of the entrance means are not highly significant to the practice of the invention, the disposition of the holes and entrance means 34 in the walls of the fenestrated tube 20 is very significant to the attainment of preferred operating results. It has been found that substantially all of the entrance means should be positioned for optimum effect, the most preferable situation being where there are no two entrance means positioned on the same transverse level of the tube and a minimum number positioned on the same axial line on the tube. As is shown by way of example in FIG. 1A of the drawings, the entrance means are arranged around the tube in a generally staggered spiral pattern so that there are no two entrance means positioned on the same transverse level of the tube and a minimum number positioned on the same axial line on the tube. This orientation provides the positioning of entrance means such that, most optimally, when also substantially equidistantly spaced in a staggered spiral pattern, they cover the entire surface of the blending tube as uniformly as possible while minimizing the number of such means on any given transverse level or axial line of the tube.

Baffle means 22 is made of a rigid material and need not be any particular size. The purpose of this baffle, as previously indicated, is to cooperate with the lower wall 18 of chamber 10 to define a flow-modifying, annular space through which the free-flowing granular materials can flow unimpeded. The baffle also prevents the preferential flow of the granular materials in the center of the bin. The slope of the upper surface of baffle 22 desirably forms an angle below the horizontal greater than the angle of repose of the granular materials being blended. Thus, the baffle is rendered self-cleaning.

Material outlet means 14, which also serves as gas (air or other gas inert to the granular material) inlet means, passes through the base of chamber 10.

As shown in the various embodiments of the apparatus of the invention as shown in the various FIGS. of the drawings, equivalent elements are assigned the same reference numerals.

In the preferred embodiment of FIG. 1 of the drawings, the chamber is closed and is ideally suited for the blending of granular materials on a batch basis. Both the blending and conveying tubes have baffles and skirts, respectively. The deflector means is secured to the cover of the chamber.

The embodiment of FIG. 2 of the drawings is similar to that of FIG. 1 but has an open chamber for the continuous blending of granular material.

The embodiment of FIG. 3 is similar to that of FIG. 1 but is provided with fluid inlet conduits 36 for the coating or other wetting of the granular material batch during the blending operation.

Figure 4:
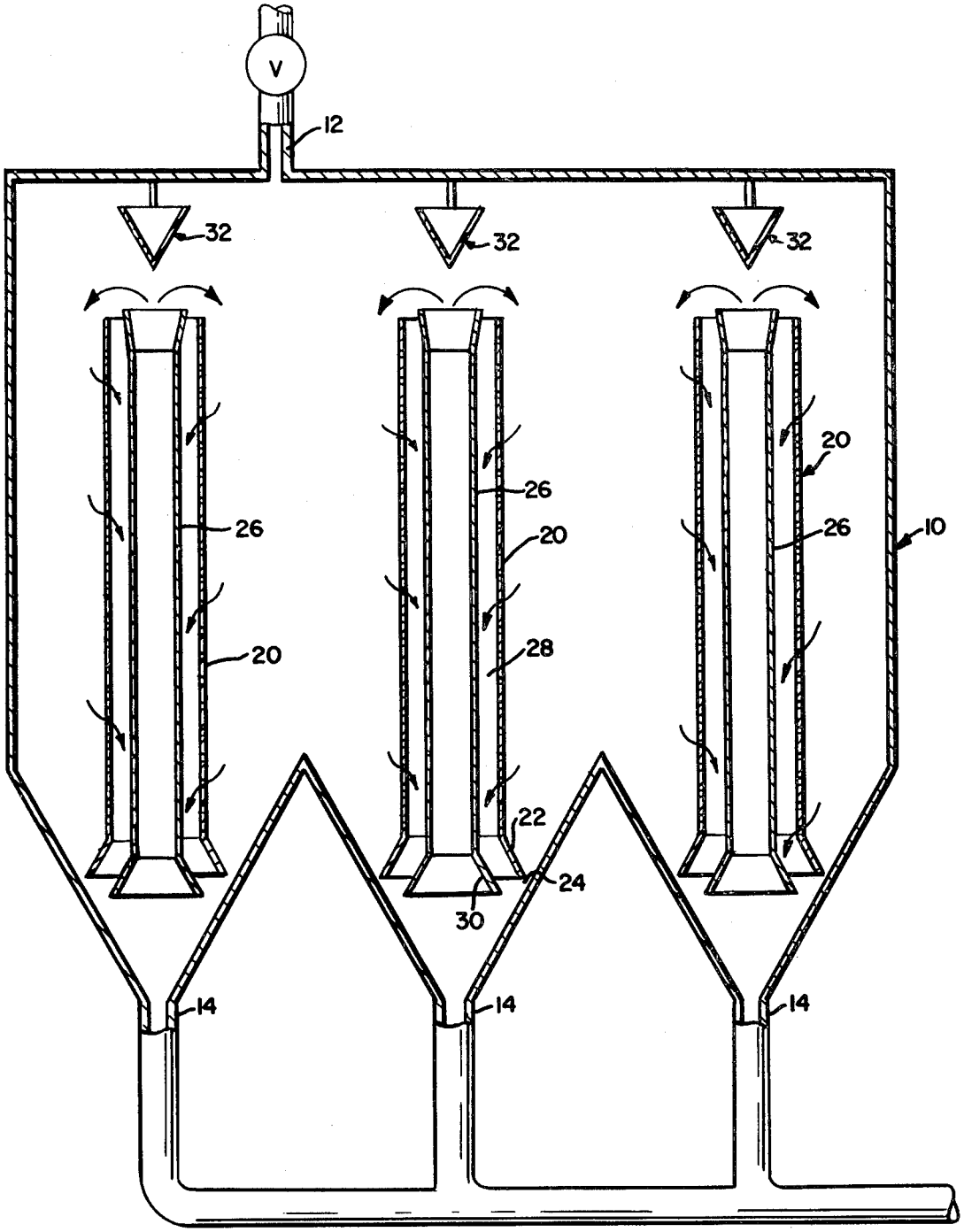

The embodiment of FIG. 4 contains a plurality (three) of blending and conveying tube combinations similar to that of FIG. 1, all positioned within the same chamber having a plurality (three) of tapered base portions into which a separate material outlet-gas inlet conduit feeds.

Figure 5:
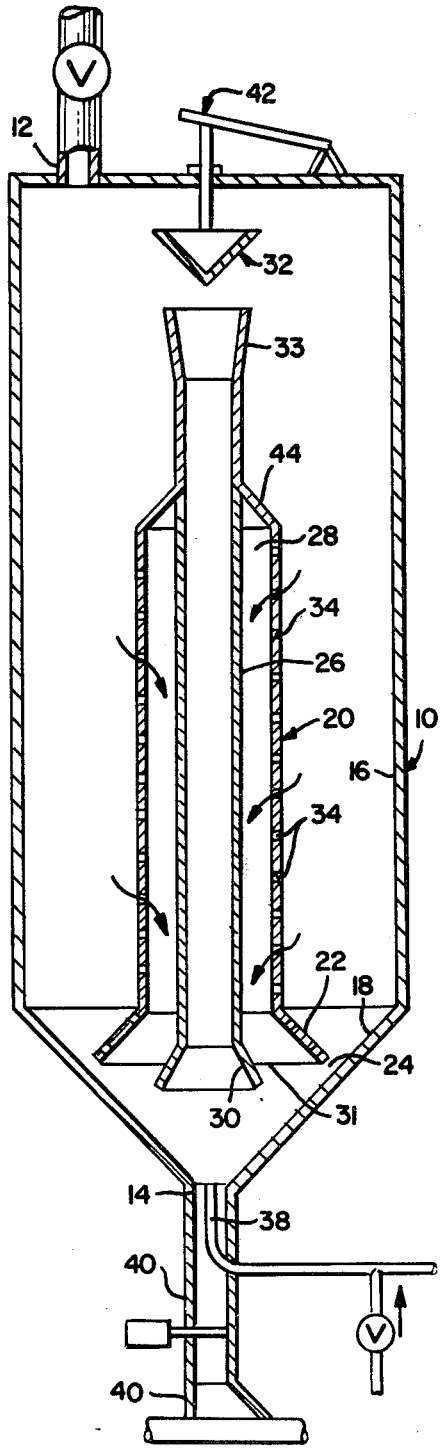

The embodiment of FIG. 5 shows in greater detail blending apparatus of the invention similar to that of the embodiment of FIG. 1 of the drawings. However, separate gas inlet means 38 and material outlet means 40 are shown, together with means 42 for adjusting the positon of deflector 32 into registry with the upper diffuser 33 end of the conveying tube. Also shown are conical closure means 44 for terminating the upper end of the annular space 28 between the blending and conveying tubes.

Figure 6:
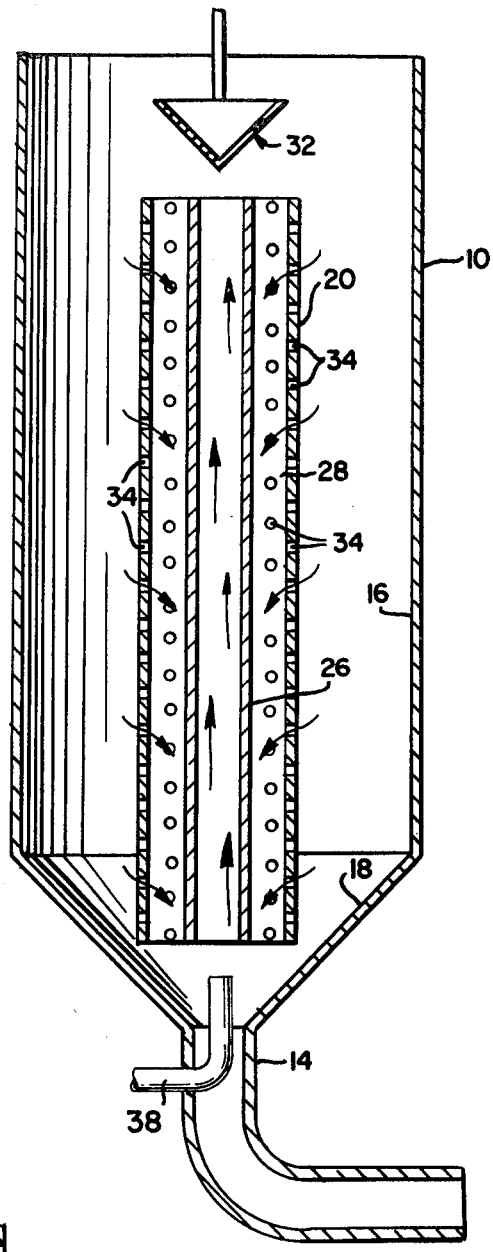

The embodiment of FIG. 6 of the drawings shows open blending apparatus not having a baffle, skirt or diffuser but embodying the essential apparatus elements of the invention.

OPERATION OF THE APPARATUS

The mixing mechanism is composed, basically, of the perforated blending tube and hopper. The dimensions, number and distribution of holes in the blending tube, the diameter of the blending tube, the angle of the blending skirt at the bottom of the blending tube and the dimensions and location of the opening between the skirt and hopper are all derivable from the flow properties test data of the granular materials to be blended and the materials of the tubes and bin walls. Thus, the materials to be blended can be withdrawn uniformly in optimal proportions and rates from the different levels in the bin including the material from the lowest level through the opening between hopper and blending skirt. The angle of the hopper base is derivable from the coefficient of internal friction and the coefficient of wall friction of the specific materials to be blended in order to eliminate any "dead" regions while maximizing the bin capacity.

The bottom of the blender below the skirts and around the cylindrical entrainment section above the nozzle defines an entrainment zone in which the mixed material flowing down from the blending tube and hopper is fluidized and ready to be air conveyed back to the top of the bin. The distance between the top of the nozzle and the bottom of the skirt is the entrainment distance which is highly significant to the optimum performance of the blender. Along this distance, the conveying air from the air nozzle picks up the mixed solids in the fluidized bed outside the entrainment area. Optimal selection of this distance will achieve the maximum mass recirculation rate for a given air blower output and thus minimize the operating costs. This mass recirculation rate is designed to be compatible with the designed gravity flow rate of the mixed solids. This entraining mechanism does not disturb the feeding mechanism. Therefore, these two critical mechanisms can be controlled separately resulting in high efficiency and scale-up confidence.

Figure 7:
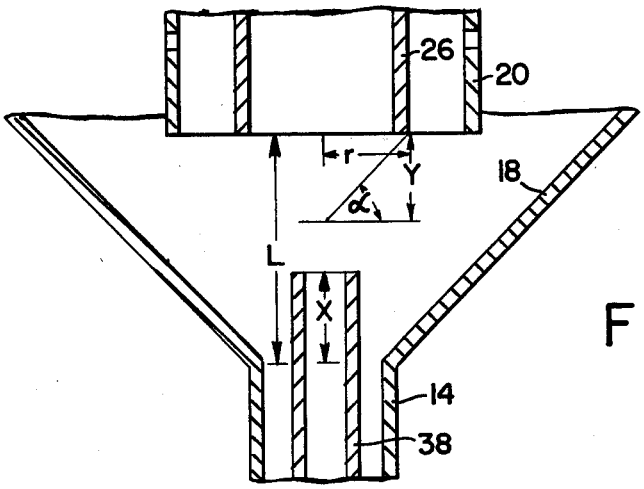
FIG. 7 is a partial sectional view of the entrainment zone near the base of a blending chamber of apparatus embodying the invention.

An enlarged view of the entrainment zone is shown in FIG. 7 of the drawings. The blending tube 20 and conveying tube 26 there employed are unskirted. The inlet gas tube 38 enters the base 18 of the chamber through outlet 14 and extends into the container a distance designated X which is at least a distance Y from the base of the conveying tube 26. This point of discharge of gas from tube 38 through the entrainment zone and into conveying tube 26 is determined to be such as to prevent an aspirating action and to provide positive conveying of the material being blended. Such entrainment requires that the gas inlet tube not extend beyond a maximum into the zone, thereby providing the minimum standoff value for Y. The following equation sets forth the maximum distance which the gas inlet tube can be inserted into the base of the container.

$$X \leqq L - r \operatorname{Tan} \alpha,$$

wherein X is the distance between the base of the chamber and the point of discharge, L is the overall distance between the base of the chamber and the base of the conveying tube, r is the outer radius of the conveying tube and $\alpha$ is the angle of repose of the granular material being blended, as defined hereinbelow.

It has been found that when an annular skirt 30 is optionally employed near the base of the conveying tube, the lower base of the skirt projects to a point below the base of the conveying tube. Under such conditions, it will be necessary to determine the point of gas inlet discharge from tube 38 by use of the equation in which the radius r is the outer radius of the annular skirt 30, the angle $\alpha$ is taken from the lower base of the skirt and the distances Y and L are measured from the lower base of the skirt.

The angle of repose for various materials is known to the art as referred to in "Methods of Moving Materials", page 10-2 et seq. Marks' Standard Handbook For Mechanical Engineers, Seventh Edition, McGraw-Hill Book Company. It refers to the angle formed by a cone created by free flow of a material from a bin to a horizontal surface. The following Table I sets forth weight, angles of repose and characteristics for various bulk material commodities as taken from the compilation prepared by Pullman-Standard Co. of Hammond, Ind.

TABLE I

| Material | Weight #/cu. ft. | Angle of Repose | *Characteristics |
|---|---|---|---|
| Alumina, fine | 35 | 55° | |
| Alumina | 55–65,100 | 36° | Fine, highly abrasive |
| Alumina, sized or briquette | 65 | 22° | |
| Calcium oxide (lime) | 27 | 43° | Fine |
| Carbon, activated | 8–20 | under 30° | Fine, abrasive |
| Carbon, ground | 50 | 21° | |
| Carbon black, pelletized | 20–25,40 | under 30° | Fine, non-abrasive, degradable, packs under pressure, absorbs moisture |
| Carbon black, powder | 4–7 | over 45° | Very fine, non-abrasive, packs under pressure |
| Carbon coke, crushed | 30 | 28° | |
| Cinders, coal | 40 | 30°–45° | Lumpy, very abrasive |
| Clay, calcined | 8–100 | 30°–45° | Fine, very abrasive, dust or fumes harmful to life |
| Clay, ceramic, dry fines | 60–80 | 30°–45° | Very fine, non-abrasive |
| Clay, lumpy, loose | 40–100 | 35° | |
| Clay, fire, powdered | 25–80 | 45° | |
| Clay, firebrick | 100–120 | 35° at 100# | Granular, abrasive |
| Clay, blended for tile | 45 | 45° | Powdered, 11% moist |
| Diatomaceous earth | 11–17 | 30°–45° | Very fine, very abrasive, aerates, packs under pressure |
| Polyethylene pellets | 30–35 | 23° | Fine, non-abrasive |
| Polyvinyl chloride resin | 18–40 | | Granular |

TABLE I-continued

| Material | Weight #/cu. ft. | Angle of Repose | *Characteristics |
|---|---|---|---|
| Polystyrene beads | 40 | 30°-45° | Fine, non-abrasive |

*Particle size characteristics are defined as follows:
Very fine - 100 mesh and under
Fine - ⅛" mesh and under
Granular - ½" mesh and under
Lumpy - containing lumps over ½"

The recirculation system is composed of the air nozzle, the conveying tube with the conveying tube inlet and skirt at the bottom, a diffuser, and a deflector. The size (diameter) of the nozzle is designed to provide the air pressure and the flow rate required by the recirculation system without affecting the feeding mechanism previously described. This eliminates the cumbersome configuration used in other systems using air. The configuration of the skirt at the bottom of the conveying tube, including the angle, and lower diameter is designable to contain the air jet from the nozzle without disturbing the feeding of mixed solids from the fluidized bed. This design will also minimize the counter flow of air along the annular area between the conveying and blending tubes. Therefore, the gravity flow of solids through the holes in the blending tube and the annular area between the hopper wall and blending skirt will not be significantly affected by this back pressure. The diffuser at the top of the conveying tube converts the kinetic energy of conveying air into pressure, thus recovers air pressure while reducing the velocity of the mixed solids being transported upward through the conveying tube. The cone shaped deflector above the top of the conveying tube redirects the upward vertical velocity of the granular solids and spreads the pellets uniformly onto the top of the resin bed. The reduction of air velocity in this design minimizes the product degradation and fines generation in the operation.

The system described in this invention could be also used for a purging operation. Such operations are required in order to expel any gas which evolves from the pellets (such as ethylene in low density polyethylene) as a result of gas entrainment in the polymer during the production process. The purging operation prevents the accumulation of explosive mixtures (i.e., gas and air) in the blending bin. The same air supply nozzle used for the recirculation operation is used for purging operation and the deflector mentioned above is lowered to block the top end of the conveying tube in order to force the air performing the purging function.

The features described above yield significant advantages of this blending apparatus over others, including:

The system could be scaled up to very large capacity ($\sim$15,000 ft.$^3$) and it eliminates the requirement for separate storage, purging, and blending systems.

The configuration of the hopper section is determined by the kinematics of the specific granular solids to be blended. This eliminates the "dead" region of solids in the hopper section found in other apparatus during the blending operation. This results in better mixing performance with no cross-contamination.

The blending apparatus of the invention ensures the flow pattern of solids in the resin bed to be a combination of "Mass Flow" and "Core Flow". The flow pattern not only guarantees a uniform downward motion of material in the resin bed but also provides sufficient back mixing. In addition, due to this flow pattern the peak stresses at the junction of the hopper and vertical walls during the blending and discharge operations are smaller than obtained with a pure mass flow pattern, thus reducing the structural cost and the hazard of bin failure.

The materials are blended in a controlled proportion and rate in the apparatus of the invention with high performance.

The apparatus of the invention requires less overall operation time and achieves better mixing than other blenders; and the results are consistent.

Due to the short operation time, the generation of streamers and fines in low density polyethylene is reduced, thus reducing the cross-contamination hazard of different materials blended in the system.

In comparison with most existing blenders using air, the air supply system in the present apparatus is considerably simpler.

The fluidization and entrainment section enables the conveying air to transport the solids at the maximum rate for a given blower output and thus reduces operating time and cost as well as investment cost.

The conveying skirt contains the air jet from the nozzle, thus utilizing the conveying air in an optimum way and provides a proper amount of purging air flowing through the material in the bin.

The mixed solids are recirculated back to the top of the bin via the shortest possible distance — the net vertical distance — resulting in a minimum power consumption, and a reduction of product degradation and cross-contamination hazard.

The diffuser section at the top of the conveying tube ensures maximum pressure recovery and low terminal velocity of resin resulting in lower operating cost and less product degradation.

The blender can be used as a purging bin by moving the deflector down to close the top of the conveying tube and utilizing the same air supply nozzle for purging as is used for conveying.

There are no moving parts in the apparatus of the invention except the pellet deflector which is kept closed during the purging cycle and open during all other operations.

The apparatus of the invention requires minimal maintenance and is very easy to clean.

The simple and "clean" internal configuration ensures no streamer hang-ups which results in cross-contamination.

This system can be employed either in a batch type operation (FIG. 1) to meet the most stringent mixing standard or in a continuous flow operation (FIG. 2) to blend materials for which the mixing standard is less stringent. In a continuous operation the conveying air supply is eliminated and the system is operated by gravity force alone. The loading, blending and discharging of material proceed simultaneously in this case.

With proper installation of a dispension head for spraying and metering liquids, the apparatus of the invention can be used for reagent, liquid coating of solids, liquid additives and subsequent liquid-solids mixing processes as well (see FIG. 3).

The concept of the apparatus of the invention can also be utilized in a single large storage system (see FIG. 4) by inserting a number of controlled mixing and recirculation mechanisms in order to blend the materials being stored.

EXAMPLE

A pilot plant of apparatus of the invention of the embodiment shown in FIG. 5, having an equivalent capacity of 75 ft.$^3$ was constructed.

The apparatus was used to blend samples of high or low density polyethylene material. The mixing performance of the blender was evaluated by statistical methods indicating the degree of dispersion of colored pellets in the mixture samples. Mean weight, standard deviation, coefficient of variation were calculated from the test data and listed in the following Tables II and III.

The test results indicated that the mixing performance of this design is better than that of any other blender.

TABLE II (50 gram samples)

AIM: 0.943396 gram

| | BLACK | GRAY | AMBER |
|---|---|---|---|
| Mean Weight (gram) | 0.954 | 0.975 | 0.927 |
| Standard Deviation (gram) | 0.144 | 0.185 | 0.179 |
| Coefficient of Variation | 15.21% | 19.65% | 18.97% |
| Random Coefficient of Variation | 15.68% | 15.68% | 15.68% |
| Net Coefficient of Variation | −0.47% | 3.97 | 3.29% |

TABLE III (200 gram samples)

AIM: 3.77358 gram

| | BLACK | GRAY | AMBER |
|---|---|---|---|
| Mean Weight (gram) | 3.550 | 3.750 | 3.750 |
| Sandard Deviation (gram) | 0.441 | 0.354 | 0.280 |
| Coefficient of Variation | 11.70% | 9.38% | 7.42% |
| Random Coefficient of Variation | 7.84% | 7.84% | 7.84% |
| Net Coefficient of Variation | 3.96% | 1.54% | −0.42% |

What is claimed is:

1. Apparatus for blending free-flowing granular materials comprising: an outer chamber having walls which converge toward and terminate in outlet means at the base thereof; substantially vertically-positioned fenestrated blending tube means spaced above said outlet means having a plurality of entrance means therein; solid, conveying tube means extending substantially vertically through and coaxial within said blending tube means and defining an annular space therebetween; an entrainment zone positioned between said base of said conveying tube means and the base portion of said chamber; and gas inlet means positioned in said chamber to discharge gas upwardly into and through said entrainment zone toward the base inlet of said conveying tube means; the distance of the point of gas inlet discharge into said entrainment zone from said base of said chamber is defined by the equation:

$$X \leqq L - r \operatorname{Tan} \alpha,$$

wherein X is the distance between the base of said chamber and said point of discharge, L is the overall distance between said base of said chamber and said base of said conveying tube, r is the outer radius of said conveying tube and $\alpha$ is the angle of repose of the granular material being blended.

2. Apparatus for blending free-flowing granular materials in accordance with claim 1, wherein substantially all of said entrance means are positioned around the periphery of said fenestrated tube means in a pattern which minimizes the number of such entrance means being oriented in any transverse or axial line on said tube means.

3. Apparatus for blending free-flowing granular materials in accordance with claim 1, wherein divergent baffle means is provided around the outer walls of said blending tube means and extending below substantially all of said entrance means, said baffle means being so shaped and positioned as to define a flow-modifying generally annular clearance between said baffle means and said walls of said chamber.

4. Apparatus for blending free-flowing granular materials in accordance with claim 1, wherein diverging skirt means is provided near the base of said conveying tube means, said point of gas inlet discharge into said entrainment zone being determined by said equation in which r is the outer radius of the base of said diverging skirt means and $\alpha$ and L are taken from such base of said diverging skirt means when determining the value of X.

5. Apparatus for blending free-flowing granular materials in accordance with claim 1, wherein conically-shaped diffuser section means are provided at the upper end of said conveying tube means.

6. Apparatus for blending free-flowing granular materials in accordance with claim 1, wherein moveable closure means are provided to register in and effect the closure of the top of said conveying tube means in order to permit purging of said conveying tube means.

7. Apparatus for blending free-flowing granular materials comprising: an outer chamber having walls which converge toward and terminate in a plurality of outlet means at the base thereof; a plurality of substantially vertically-positioned fenestrated blending tube means spaced above said outlet means having a plurality of entrance means therein; solid, conveying tube means extending substantially vertically through and coaxial within each of said blending tube means and defining an annular space therebetween; an entrainment zone positioned between said base of each of said conveying tube means and the base portion of said chamber; and gas inlet means positioned in said chamber to discharge gas upwardly into and through said entrainment zone toward the base inlet of each of said conveying tube means; the distance of the point of gas inlet discharge into said entrainment zone from said base of said chamber is defined by the equation:

$$X \leqq L - r \operatorname{Tan} \alpha,$$

wherein X is the distance between the base of said chamber and each of said points of discharge, L is the overall distance between said base of said chamber and the base of each of said conveying tubes, r is the outer radius of each of said conveying tubes and $\alpha$ is the angle of repose of the granular material being blended.

8. Apparatus for blending free-flowing granular materials in accordance with claim 7, wherein substantially all of said entrance means are positioned around the periphery of said fenestrated tube means in a pattern which minimizes the number of such entrance means being oriented in any transverse or axial line on said tube means.

9. Apparatus for blending free-flowing granular materials in accordance with claim 7, wherein conically-shaped diffuser section means are provided at the upper end of each of said conveying tube means.

10. Apparatus for blending free-flowing granular materials in accordance with claim 7, wherein moveable closure means are provided to register in and effect the closure of the top of each of said conveying tube means in order to permit purging of said conveying tube means.

* * * * *